United States Patent [19]

Wiseman

[11] 4,339,020

[45] Jul. 13, 1982

[54] LADDER SUPPORT

[76] Inventor: Donald H. Wiseman, 513 Tower St., Burlington, Wis. 53105

[21] Appl. No.: 200,069

[22] Filed: Oct. 23, 1980

[51] Int. Cl.[3] ..... E06C 7/48

[52] U.S. Cl. ..... 182/214; 182/107

[58] Field of Search ..... 182/214, 107, 108, 229; 248/210, 238, 235

[56] References Cited

U.S. PATENT DOCUMENTS

| | | | |
|---|---|---|---|
| 2,993,562 | 7/1961 | Hussey | 182/141 |
| 3,318,416 | 5/1967 | Robinson | 182/214 |
| 3,419,109 | 12/1968 | Costlow | 182/214 |
| 3,713,510 | 1/1973 | O'Dell | 182/214 |

*Primary Examiner*—Reinaldo P. Machado

*Attorney, Agent, or Firm*—Richard P. Ulrich

[57] ABSTRACT

A ladder support which is attached to the top portion of ladder rails, the support having a large bearing surface which is covered with soft fabric and being adapted to fit ladders of various sizes and made of various materials.

1 Claim, 3 Drawing Figures

LADDER SUPPORT

BACKGROUND AND SUMMARY OF THE INVENTION

This invention relates to ladder supports. The principal object of this invention is to provide a device which will prevent a ladder from damaging the surface against which it is leaning. In general ladders damage surfaces by marring the finish or actually deforming the surface material because the force of the ladder rails against the surface is concentrated in the small area on which the ladder rails rest.

It is a further object of this invention to make the support in a way which allows it to be quickly removed from a ladder.

It is an additional object of this invention to provide the means for attaching the device to ladders of various materials, including but not limited to metal and wood.

Another object of this invention is to provide the means for offsetting the upper end of the ladder from the surface against which it is leaning so that the user may, for example, easily change storm windows or clean rain gutters.

DESCRIPTION OF THE PREFERRED EMBODIMENT

Figure 1:
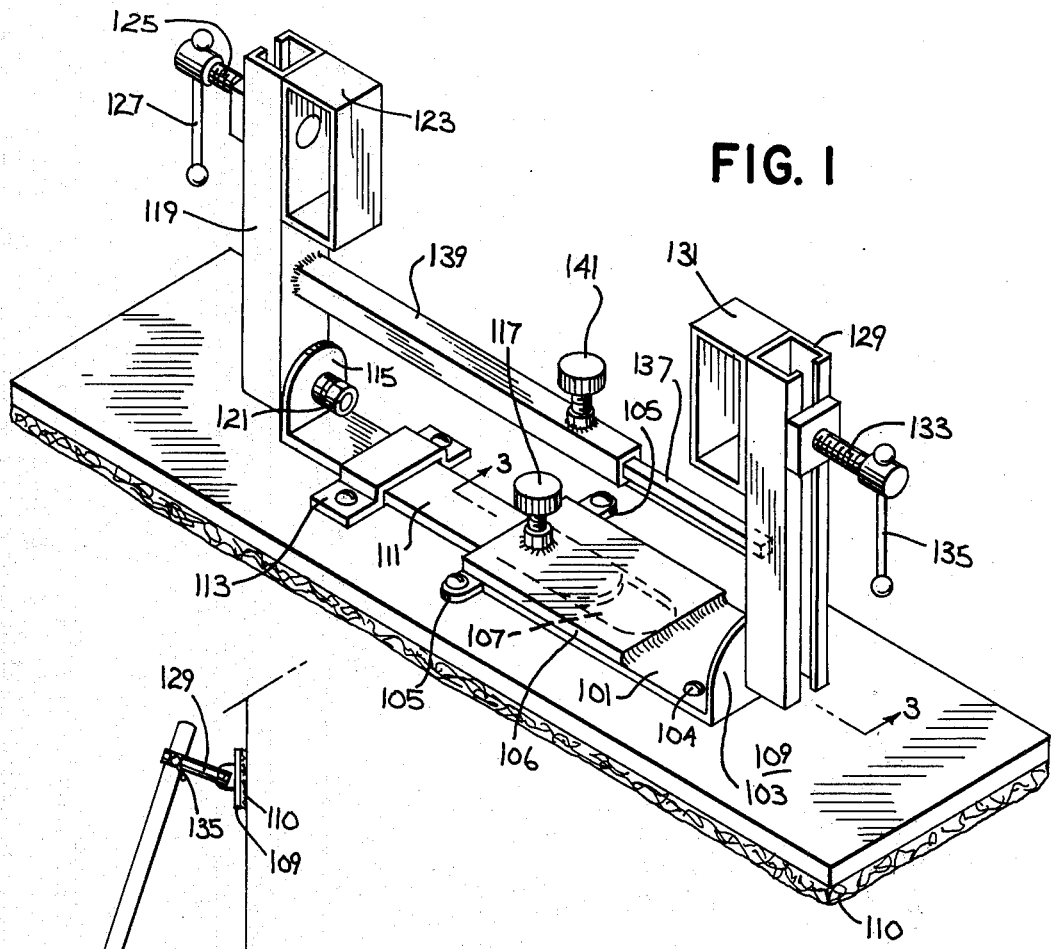
FIG. 1 is a perspective view of the device
Figure 2:
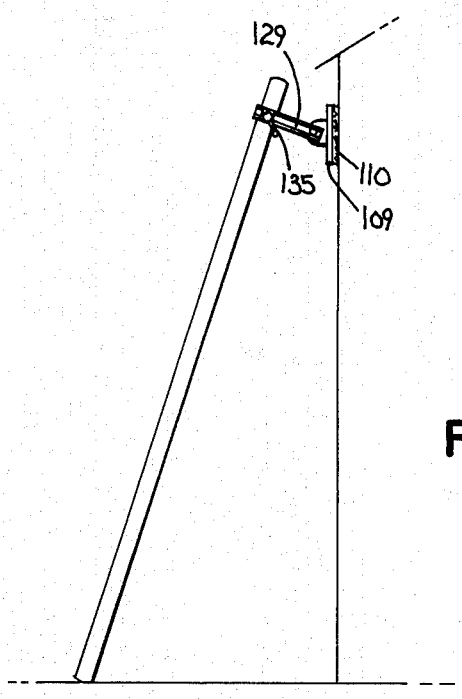
FIG. 2 shows a ladder with the device attached leaning against a building.
Figure 3:
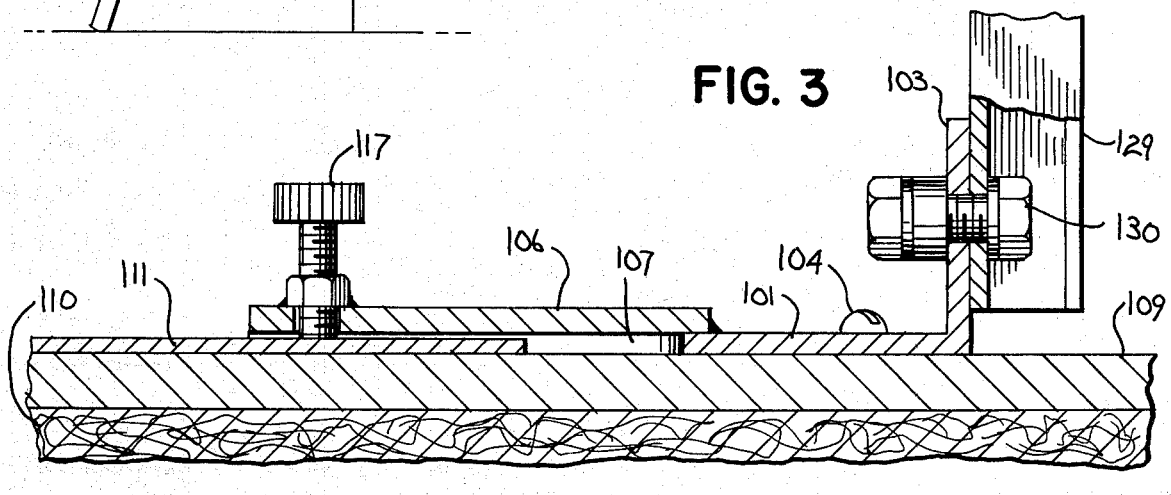
FIG. 3 is a sectional view taken in direction 3—3.

The ladder support as is shown in the figures has a first L-shaped bar 101 the horizontal leg of which is attached to rectangular plate 109 by screws 104 or any other suitable means. Bar 106, a first end of which is attached to the top surface of bar 101, has a pair of feet formed on its other end. In addition to providing points at which bar 106 can be attached to plate 109, feet 105 elevate the second end of member 106 above the surface of plate 109 a distance equal to the thickness of L-shaped bar 101 thereby forming pocket 107 under bar 106 when it is attached to plate 109. Obviously, a single piece of metal stock could be formed so that it would be equivalent to the combination of members 101 and 106 and is within the contemplation of this invention. It is also realized that other materials such as various plastics could be shaped to form the parts of this invention.

Rectangular plate 109, which can be made of wood or any other suitable material, is longer than the distance between the ladder rails of the ladder upon which the device is used and wider than the width of bar 106. The surface of plate 109 opposite to the surface to which bar 106 is attached is covered with carpet 110 or a similar material.

The horizontal leg of second L-shaped bar 111 may be inserted in pocket 107 and slidably attached to plate 109 with guide member 113. L-shaped bar 111 is held in place after positioning by thumb screw 117.

Column 119 is pivotably attached on one end to vertical leg 115 of L-shaped bar 111 with nut and bolt 121. U-bracket 123, which circumscribes an area which is slightly larger than the ladder rails in both directions, is attached to the other end of column 119. Clamp screw 125 is threaded through column 119. As clamp screw 125 is advanced, one end of it forces the ladder rail against U-bracket 123. Handle 127, which is attached to the other end of clamp screw 125, provides a convenient means for turning the clamp screw.

Column 129 is pivotably attached on one end to vertical leg 103 of L-shaped bar 101 with nut and bolt 130. U-bracket 131, which circumscribes an area larger in both dimensions than the ladder rails to which the device is attached, is affixed, by any convenient means, to the other end of column 129. Clamp screw 133 is threaded through column 129. When clamp screw 133 advances, the inner end of it clamps the ladder rail against U-bracket 131. Handle 135, which is attached to the outer end of clamp screw 133, provides the means for conveniently turning clamp screw 133.

Pipe 137 is attached to column 129 on one end at a point below bracket 131. Pipe 139, the inner diameter of which is slightly larger than the outer diameter of pipe 137, is attached to column 119 on one end below bracket 123 and slidably engaged with pipe 137 on the other end. Set screw 141 locks the pipes in place when the columns are positioned as desired.

OPERATION

Set screws 117 and 141 are loosened so that the distance between column 119 and column 129 can be adjusted to accommodate the ladder being used. Clamp screws 125 and 133 are retracted so that their ends do not impinge on the space enclosed by brackets 123 and 131. The device is slipped over the ends of the ladder rails and the clamp screws set. Finally set screws 117 and 141 are tightened to hold the assembly in position after it has been attached to a ladder. After this initial set procedure, set screws 117 and 141 do not have to be touched until the device is used with a different ladder.

What is claimed is:

1. A ladder support comprising: a plate, one side of which is covered with a soft fabric; a first L-shaped bar the horizontal leg of which is attached to the plate; a flat bar, one end of which is attached to the top surface of the horizontal leg of the first L-shaped bar and having a pair of feet on the other end, the feet being attached to the plate and displaced with respect to the bottom surface of the flat bar so that a pocket is formed between the bar and the plate; a second L-shaped bar, the horizontal leg of which is inserted in the pocket, and which is slidably attached to the plate; a first column, the bottom end of which is pivotably attached to the vertical leg of the first L-shaped bar; a first U-bracket which is attached to the upper portion of the first column; a second column, the bottom end of which is pivotably attached to the vertical leg of the second L-shaped bar; a second U-bracket which is attached to the upper portion of the second column; first and second clamp screws which are threaded through the first and second columns respectively and may be advanced into the space circumscribed by the first and second U-brackets; and adjustable pipe means connected between the columns for maintaining the position of the columns relative to each other.

* * * * *